US008257550B2

(12) United States Patent
Dahl et al.

(10) Patent No.: US 8,257,550 B2
(45) Date of Patent: Sep. 4, 2012

(54) METHOD OF BLEACHING A PULP

(75) Inventors: Mårten Dahl, Ankarsvik (SE); Sara Eriksson, Sundsvall (SE); Solveig Nordén, Sundsvall (SE)

(73) Assignee: Metso Paper, Inc. (FI)

( * ) Notice: Subject to any disclaimer, the term of this patent is extended or adjusted under 35 U.S.C. 154(b) by 63 days.

(21) Appl. No.: 12/867,985

(22) PCT Filed: Feb. 12, 2009

(86) PCT No.: PCT/SE2009/050152

§ 371 (c)(1),
(2), (4) Date: Aug. 17, 2010

(87) PCT Pub. No.: WO2009/108111

PCT Pub. Date: Sep. 3, 2009

(65) Prior Publication Data

US 2011/0036524 A1 Feb. 17, 2011

(30) Foreign Application Priority Data

Feb. 28, 2008 (SE) ..... 0800475

(51) Int. Cl.
*D21C 9/14* (2006.01)
*D21C 9/16* (2006.01)
*D21C 9/02* (2006.01)

(52) U.S. Cl. ..... 162/67; 162/60; 162/78; 162/88

(58) Field of Classification Search ..... 162/78, 162/87–89, 60–62, 66–67
See application file for complete search history.

(56) References Cited

U.S. PATENT DOCUMENTS

| | | | | |
|---|---|---|---|---|
| 3,423,282 | A * | 1/1969 | Rerolle et al. | 162/65 |
| 4,238,281 | A * | 12/1980 | Histed | 162/60 |
| 5,296,099 | A * | 3/1994 | Griggs et al. | 162/57 |
| 5,589,031 | A * | 12/1996 | Farnstrand et al. | 162/65 |
| 5,938,892 | A * | 8/1999 | Maples et al. | 162/30.1 |
| 6,221,209 | B1 * | 4/2001 | Desprez et al. | 162/65 |
| 7,182,835 | B2 * | 2/2007 | Lindstrom et al. | 162/29 |
| 2004/0112556 | A1 * | 6/2004 | Nasholm | 162/76 |
| 2005/0045291 | A1 * | 3/2005 | Ragnar et al. | 162/61 |
| 2010/0243183 | A1 * | 9/2010 | Vehmaa et al. | 162/29 |
| 2011/0036524 | A1 * | 2/2011 | Dahl et al. | 162/60 |
| 2011/0174451 | A1 * | 7/2011 | Dietz | 162/67 |

FOREIGN PATENT DOCUMENTS

| | | | |
|---|---|---|---|
| EP | 480469 | A2 * | 4/1992 |
| JP | 2003342886 | A * | 12/2003 |
| SE | 466062 | | 12/1991 |
| SE | 504210 | C2 | 12/1996 |
| SE | 526162 | | 7/2005 |
| WO | 91/17306 | A1 | 11/1991 |
| WO | 02/075046 | A1 | 9/2002 |
| WO | WO 2009108111 | A1 * | 9/2009 |
| WO | WO 2009139693 | A1 * | 11/2009 |

OTHER PUBLICATIONS

Eiras et al., Optimization of the High Temperature Chlorine Dioxide Stage (DHT) for Hardwood Kraft Pulp, 2001, TAPPI Pulping Conference, pp. 1-13.*

Gomes et al., "Characterization and biodegradability of effluents derived from hot acid hydrolysis and hot chlorine dioxide bleaching of *Eucalyptus* pulp," Jun. 2005, Appita, vol. 1 pp. 299-304.*

International Search Report, PCT/SE2009/050152, dated May 28, 2009.

Dominique Lachenal et al., "High temperature chlorine dioxide delignification: a breakthrough in ECF bleaching of hardwood kraft pulps", Pulping Conference 1998, pp. 601-604, abstract, table 3.

Papermaking Science and Technology/edited by Gullichsen, J et al., Book 6A, "Chemical Pulping" published by Fapet Oy, printed 2000, ISBN 952-5216-06-3 (book 6), p. A642-A643, tables 4 och 5.

Handbook of pulp/ edited by Herbert Sixta, published by Weinheim: Wiley-VCH, cop. 2006, ISBN 3-527-30999-3, pp. 768, 874-876.

* cited by examiner

*Primary Examiner* — Jose A Fortuna
(74) *Attorney, Agent, or Firm* — Lerner, David, Littenberg, Krumholz & Mentlik, LLP

(57) ABSTRACT

Methods for bleaching oxygen delignified and washed pumps having a consistency of between 8 and 20% are disclosed including a first chlorine dioxide bleaching step, washing the bleached pulp, subjecting the washed pulp to an alkaline extraction step to obtain an alkali-containing pulp, adding chlorine dioxide and adjusting the pH in a second chlorine dioxide bleaching step performed directly after the alkaline extraction step without an intermediate washing step, and subjecting the bleached alkali-containing pulp to a peroxide treatment step directly after the second chlorine dioxide bleaching step or with an intermediate washing step prior to the peroxide treatment step.

10 Claims, No Drawings

METHOD OF BLEACHING A PULP

CROSS-REFERENCE TO RELATED APPLICATIONS

The present application is a national phase entry under 35 U.S.C. §371 of International Application No. PCT/SE2009/050152 filed Feb. 12, 2009, published in English, which claims priority from Swedish Application No. 0800475-6 filed Feb. 28, 2008, all of which are incorporated herein by reference.

FIELD OF THE INVENTION

The present invention relates to a method of bleaching a pulp. More specifically, the present invention relates to a method of bleaching an oxygen delignified pulp, such as an oxygen delignified hardwood pulp, to a brightness of 88 to 92% ISO.

BACKGROUND OF THE INVENTION

In bleaching processes for both softwood and hardwood pulps, the pulps are normally delignified in one or more oxygen steps and thereafter bleached by means of various sequences comprising chlorine dioxide steps, extraction steps, peroxide steps, etc.

Hardwood pulps differ from softwood pulps in that they contain high amounts of Hexenuronic Acid (HexA). The amount of HexA depends on the raw material used and the cooking conditions. Modern methods of cooking, which utilize relatively low cooking temperatures, normally render high contents of HexA. HexA is oxidized by potassium permanganate ($KMNO_4$) and thereby contributes to the kappa number. In a hardwood pulp with a kappa value of 10, 50 to 70% of the kappa value could be a result of HexA and only 30 to 50% is attributed to lignin and other compounds.

During bleaching, HexA can be reduced by oxidation with bleaching chemicals such as chlorine dioxide and ozone. A more economical way to do so is to degrade HexA by means of acid hydrolysis at high temperature, which lowers the amount of double bonds in the remaining pulp. Therefore, a hot chlorine dioxide step ($D_{HT}$) is often accommodated in modern bleach plants. In this stage both oxidation and acid hydrolysis are performed. The high temperature in $D_{HT}$ can provide a reduction of the kappa number from for example 10.5 to 2.5. Hence, most of the reduction of the kappa number, typically 85 to 90%, is achieved in such a $D_{HT}$-step and only a minor part, typically 10 to 15%, in a following extraction step (E). Moreover, it is believed that lignin is also degraded into smaller, more water soluble pieces during the $D_{HT}$-step.

Swedish Patent No. 466,062 discloses a method of bleaching a chemical pulp in a sequence comprising at least four bleaching steps, with final bleaching in a first and a second chlorine dioxide step. Between the chlorine dioxide steps an alkaline extraction is carried out and washing takes place between the first chlorine dioxide step and extraction. Immediately after said washing step, NaOH is charged in an amount of 4 to 10 kg/ton pulp. Thereafter, an oxidizing agent is admixed in an amount of up to 2 kg/ton pulp. An acid is added for lowering the pH-value, but without effecting a complete neutralization of residual alkaline.

Swedish Patent No. 526,162 discloses a bleaching process for hardwood pulp wherein an oxygen-delignified and washed pulp is subjected to a chlorine dioxide bleaching step at high temperature, such as at least 90° C., and treated with a chelating agent without any intermediate wash. The pulp is thereafter washed and subjected to a pressurized peroxide bleaching step in which alkali is also added. The bleached pulp is finally washed in order to obtain a pulp with a brightness of 88 to 90% ISO.

International Application No. WO 02/075046 discloses a method for end bleaching of pulp comprising two chlorine dioxide steps. The pulp is washed and dewatered after the first chlorine dioxide step to a concentration of 12 to 50% in order to remove dissolved metal ions. Thereafter, alkali is added for extraction and rapid increase of the pH. Before the pulp is introduced into the second chlorine dioxide step, acid and chlorine are added to the pulp.

The previously known methods generally perform well, even though they may be fairly expensive or complex. Nonetheless, there remains a desire to further improve the bleaching, especially for hardwood pulps, and reduce the overall costs for the bleaching.

Hence, one object of the present invention is to provide a method for bleaching a hardwood pulp to a brightness of from about 88 to 92% ISO in a cost effective manner.

SUMMARY OF THE INVENTION

In accordance with the present invention, these and other objects have been realized by the invention of a method for bleaching an oxygen delignified and washed pulp having a consistency of between 8 and 20% comprising (i) subjecting the pulp to a first chlorine dioxide bleaching step to obtain a bleached pulp; (ii) washing the bleached pulp to obtain a washed pulp; (iii) subjecting the washed pulp at a consistency of between 8 and 20% to an alkaline extraction step to obtain an alkali-containing pulp; (iv) adding chlorine dioxide to the alkali-containing pulp and adjusting the pH in a second chlorine dioxide bleaching step to obtain a bleached alkali-containing pulp, wherein step (iv) is performed directly after step (iii) without any intermediate washing step; and (v) subjecting the bleached alkali-containing pulp to a peroxide treatment step directly after the second chlorine dioxide bleaching step.

In another embodiment, however, step (v) comprises subjecting the bleached alkali-containing pulp to an intermediate washing step prior to the peroxide bleach treatment step. Preferably, the method includes the first chlorine dioxide bleaching step being carried out at a temperature of between about 80 and 90° C. More preferably, the first chlorine dioxide bleaching step is carried out at a temperature of between about 85 and 95° C.

In accordance with one embodiment of the method of the present invention, the first chlorine dioxide bleaching step is carried out at a pH of between about 2 and 4.

In accordance with another embodiment of the method of the present invention, the washed pulp is subjected to an alkaline extraction step at a pH of between about 8 and 14. Preferably, the washed pulp is subjected to the alkaline extraction step at a pH of between about 9 and 12.

In accordance with another embodiment of the present invention, the pH is adjusted to an adjusted pH of between about 2 and 4.

In accordance with another embodiment of the apparatus of the present invention, the first chlorine dioxide bleaching step is carried out at a pH of between about 2.5 and 3.5.

In accordance with another embodiment of the method of the present invention, the washed pulp is subjected to the alkaline extraction step at a temperature of between about 75 and 85° C.

In accordance with another embodiment of the method of the present invention, the second chlorine dioxide bleaching step is carried out at a temperature of between about 75 and 90° C.

In accordance with another embodiment of the present invention, the pulp is a hardwood pulp or a eucalyptus based pulp.

The method of bleaching a pulp in accordance with the present invention comprises subjecting an oxygen delignified pulp to a hot chloride dioxide bleaching step at a temperature of 80 to 95° C. and a pH of 2 to 4 followed by washing. During the bleaching step, a substantial reduction of the kappa number will be accomplished. The pulp is thereafter subjected to an alkaline extraction step and a chlorine dioxide bleaching step integrated with said alkaline extraction step. In the present disclosure, integrated should be interpreted as following directly after the preceding step without any intermediate wash.

It has been determined that it is possible to obtain a brightness of more than 88% ISO when bleaching a hardwood pulp by means of the method according to the present invention. Furthermore, excellent reverted brightness can be achieved. The COD generation is also reduced compared to bleaching methods according to previous known methods used to obtain the same brightness. Moreover, the overall cost for bleaching a hardwood pulp is reduced as a consequence of lower chemical costs and/or lower investment costs for the bleaching plant, mainly as a result of fewer required washing steps.

Even though the method according to the present invention is intended for bleaching hardwood pulp, it is also believed to be suitable for bleaching softwood pulp.

DETAILED DESCRIPTION

In accordance with the present invention, an oxygen-delignified and washed pulp is subjected to a hot chlorine dioxide step ($D_{HT}$) in a reactor in order to reduce the kappa value to typically 3 or less. The hot chlorine dioxide step is performed at a temperature of 80 to 95° C., preferably 85-95° C., on a pulp having a consistency of 8 to 20%, preferably 8 to 15%, at a pH of 2 to 4, preferably pH 2.5 to 3.5, for a period of time sufficient to reduce the kappa number to the desired value. It should be noted that the time required for achieving the desired result depends on selected values of the parameters given above. However, the skilled person can easily determine the suitable period of time for the selected parameters by routine tests.

After the hot chlorine dioxide step the pulp is washed in accordance with conventional techniques, for example by using a wash-press or a dewatering-press, in order to remove the dissolved matter.

Alkali, for example in the form of a liquid containing NaOH, is thereafter added to the pulp in order to subject the pulp to an alkaline extraction step at a pH of 8 to 14, preferably pH 9 to 12, for a period of time sufficient to dissolve oxidized lignin. The consistency of the pulp should in this step be 8 to 20%, preferably 8 to 15%. The alkaline extraction step may suitably be performed at a temperature of 75 to 85° C. for 2-30 minutes, preferably 5 to 15 minutes.

Chlorine dioxide is added to the pulp directly after the alkaline extraction step, i.e. without any intermediate wash, and the pH of the pulp is adjusted to 2 to 4, preferably pH 2.5 to 4. This chlorine dioxide addition will subject the pulp to a second chlorine dioxide bleaching step. The temperature of the pulp should preferably be the same, or substantially the same, in this second bleaching step as in the alkaline extraction step. Since there is no washing step between the alkaline extraction step and the second chlorine dioxide bleaching step, these are considered to be integrated steps.

After the second bleaching step, the pulp may be subjected to a peroxide treatment. This may be performed directly after the second bleaching step, i.e. integrated with the alkaline extraction and chlorine dioxide bleaching step, or after an intermediate washing step. The peroxide treatment is performed at a temperature of from 75 to 90° C. for a period of time sufficient to accomplish the desired final brightness, such as 88 to 92% ISO, after subsequent wash of the pulp. It should be noted that the time required for achieving the desired result depends on the amount peroxide used and the temperature of the pulp given above, but can easily be determined by the skilled person by routine tests.

According to an alternative embodiment of the bleaching method of the present invention, the alkaline extraction step and the second chlorine dioxide bleaching step are repeated after an intermediate wash.

The amount of chemicals required in each step of the process according to the present invention to obtain the desired result can be easily determined by the skilled person by using common general knowledge within the field of bleaching or by mere routine tests.

It has been noted that by using a sequence comprising a hot chloride dioxide bleaching step followed by an integrated alkaline extraction and chlorine dioxide bleaching step in accordance with the present invention, it is possible to obtain a brightness of 89% ISO when bleaching a hardwood pulp. By repeating the integrated alkaline extraction and chlorine dioxide bleaching step in such a sequence, it is possible to obtain a brightness of about 92% ISO. Moreover, 92% ISO can also be obtained by using a sequence comprising a hot chloride dioxide bleaching step followed by an integrated alkaline extraction and chlorine dioxide bleaching step and a subsequent peroxide step in accordance with a preferred embodiment of the present invention.

The bleaching method according to the present invention has proven to be especially suitable for bleaching Eucalyptus-based pulps.

EXAMPLE 1

A sulphate pulp produced from *Eucalyptus grandis* wood was used for laboratory tests. The unbleached pulp had a kappa number of 18. After oxygen delignification, the pulp had a kappa number of 10.5, a viscosity of 1090 ml/g and a brightness of 65% ISO.

The pulp was bleached with two different sequences according to the invention, $S_{inv1}$ and $S_{inv2}$, and two reference sequences, $S_{Ref1}$ and $S_{Ref2}$. The sequences ($S_{inv1}$, $S_{inv2}$, $S_{Ref1}$, $S_{Ref2}$) are listed below and the results are shown in Table 1.

$S_{Ref1}$

Chlorine dioxide bleaching of a pulp with 10% consistency at 90° C. and pH 2.6 for 150 minutes followed by washing Alkaline extraction step of the pulp at 12% consistency at 85° C. and pH 10.0 for 60 minutes followed by washing A second chlorine dioxide bleaching at a pulp consistency of 12%, a temperature of 75° C. and a pH of 3.5 to 3.9 for 120 minutes followed by washing A peroxide step at a pulp consistency of 12%, a temperature of 85° C. and a pH of 10.0 for 90 minutes followed by a final washing $S_{ref2}$ Chlorine dioxide bleaching of a pulp with 10% consistency at 90° C. and pH 2.7 for 150 minutes followed by washing An alkaline extraction step of the pulp at 12% consistency at 85° C. and pH 11.3 in the presence of 0.2 MPa$O_2$ and peroxide for 60 minutes followed by washing A second chlorine dioxide bleaching at a pulp consistency of 12%, a temperature of 75° C., and a pH of 3.7 to 3.9 for 120 minutes followed by washing $S_{inv1}$ Chlorine dioxide bleaching of a pulp with 10% consistency at 90° C. and pH 2.5 for 150 minutes followed by washing An alkaline extraction step of the pulp at 12% consistency at 80° C. and pH 10.5 for 10 minutes followed by addition of chlorine dioxide in order to achieve a chlorine dioxide bleaching at 80° C. for 30 minutes, and pH 3.1 to 3.5

Addition of peroxide to the pulp in order to achieve a peroxide step at 85° C. and pH 9.5-10 for 90 minutes $S_{inv2}$ Chlorine dioxide bleaching of a pulp with 10% consistency at 90° C. and pH 2.7 for 180 minutes followed by washing An alkaline extraction step of the pulp at 12% consistency at 80° C. and pH 10.5 for 10 minutes followed by addition of chlorine dioxide in order to achieve a chlorine dioxide bleaching at 80° C. and a pH of 3.1 to 3.5 for 30 minutes followed by washing Addition of peroxide to the pulp with 12% consistency in order to achieve a peroxide step at 85° C. and pH 10.0 for 90 minutes The results show that it is possible to obtain a brightness of 90% ISO with the sequence $S_{inv1}$ of the present invention at approximately the same chemical cost as the reference sequence $S_{ref2}$. However, the sequence $S_{inv1}$ gives a much lower investment cost for a bleach plant, as it requires fewer washing steps. Furthermore, $S_{inv1}$ also provides 0.5% ISO higher reverted brightness and 20% lower COD generation than $S_{ref2}$.

The alternative sequence $S_{inv2}$ according to the present invention renders a lower chemical cost. Furthermore, it also provides 0.5% ISO higher reverted brightness and 15% lower COD generation than $S_{ref2}$.

$S_{Ref1}$ has the lowest estimated chemical cost and a slightly higher reverted brightness than the sequence $S_{ref2}$. The COD generation is also lower than $S_{ref2}$ but the investment cost for this four step sequences is substantially higher than for the sequences according to the present invention, $S_{inv1}$ and $S_{inv2}$, due to the number of washers required.

TABLE 1

| | $S_{Ref1}$ | $S_{Ref2}$ | $S_{inv1}$ | $S_{inv2}$ |
|---|---|---|---|---|
| Brightness [% ISO] | 90 | 90 | 90 | 90 |
| Bleaching stages | 4 | 3 | 2 | 3 |
| Total time [min] | 420 | 330 | 280 | 280 |
| Washers | 4 | 3 | 2 | 3 |
| Bleached pulp | | | | |
| Rev. brightness [% ISO] | 88.0 | 87.7 | 88.2 | 88.2 |
| Viscosity [ml/g] | 890 | 900 | 840 | 895 |
| COD total [kg/odt] | 24.8 | 26.1 | 20.5 | 22.0 |
| Chemicals | | | | |
| $ClO_2$ [kg active Cl] | 19 | 19.5 | 20.5 | 21.5 |
| $H_2O_2$ [kg/odt] | 3 | 3 | 3 | 3 |
| NaOH [kg/odt] | 8.5 | 11 | 11.5 | 8.5 |
| $H_2SO_4$ [kg/odt] | 3.0 | 4.0 | 6.0 | 5.5 |
| $MgSO_4$ [kg/odt] | 1.0 | 1 | 1.0 | 1.0 |
| Oxygen [kg/odt] | — | 4.0 | — | — |
| Estimated chemical cost [US$/odt] | 14.5 | 16.5 | 16.8 | 15.7 |

EXAMPLE 2

A sulphate pulp produced by a wood mixture of 70% *Eucalyptus nitens* and 30% *Eucalyptus globulus* was used for laboratory tests. The pulp had, after oxygen delignification (in a processing plant) a kappa number of 8.6, a viscosity of 935 ml/g and a brightness of 64% ISO. The pulp was bleached according to two sequences according to the present invention, $S_{inv3}$ and $S_{inv4}$, and one reference sequence $S_{Ref3}$.

The sequences ($S_{inv3}$, $S_{inv4}$ and $S_{Ref3}$) are listed below. The results for a brightness of 91% ISO are shown in Table 2 and the results for a reverted brightness of 89% ISO are shown in Table 3.

$S_{Ref3}$

Chlorine dioxide bleaching of a pulp with 10% consistency at 90° C. and pH 3.2 for 90 minutes followed by washing An alkaline extraction step of the pulp at 12% consistency at 85° C. and pH 11.3 in the presence of 0.2 MPa $O_2$ and peroxide during 60 minutes followed by washing A second chlorine dioxide bleaching at a pulp consistency of 12%, a temperature of 60 to 75° C. and a pH of 2.9 to 3.7 for 120 minutes followed by washing $S_{inv3}$ Chlorine dioxide bleaching of a pulp with 10% consistency at 90° C. and pH 3.3 for 90 minutes followed by washing An alkaline extraction step of the pulp at 12% consistency at 80° C. and pH 11.4 for 10 minutes followed by addition of chlorine dioxide in order to achieve a chlorine dioxide bleaching at 80° C. and a pH of 3.0 to 3.9 for 30 minutes followed by washing Addition of peroxide to the pulp with 12% consistency in order to achieve a peroxide step at 80° C. and a pH of 11.2 to 11.5 for 60 minutes $S_{inv4}$ Chlorine dioxide bleaching of a pulp with 10% consistency at 90° C. and pH 3.3 for 90 minutes followed by washing An alkaline extraction step of the pulp at 12% consistency at 80° C. and pH 11.4 for 10 minutes followed by addition of chlorine dioxide in order to achieve a chlorine dioxide bleaching at 80° C. and a pH of 3.0 to 3.9 for 30 minutes followed by washing An alkaline extraction step of the pulp at 12% consistency at 80° C. for 10 minutes followed by addition of chlorine dioxide in order to achieve a chlorine dioxide bleaching at 80° C. and a pH of 4.9 to 5 for 60 minutes followed by washing

TABLE 2

| | $S_{inv3}$ | $S_{inv4}$ | $S_{Ref3}$ |
|---|---|---|---|
| Brightness [% ISO] | 91 | 91 | 91 |
| Bleaching stages | 3 | 3 | 3 |
| Total time [min] | 190 | 200 | 270 |
| Washers | 3 | 3 | 3 |
| Bleached pulp | | | |
| Rev brightness [% ISO] | 89.0 | 88.3 | 88.1 |
| Viscosity [ml/g] | 830 | 820 | 850 |
| COD total [kg/odt] | 17 | 16 | 24 |
| Chemicals | | | |
| $ClO_2$ [kg active Cl] | 22 | 28 | 23 |
| $H_2O_2$ [kg/odt] | 5 | — | 3 |
| NaOH [kg/odt] | 11 | 10 | 11 |
| $H_2SO_4$ [kg/odt] | 5 | 5 | 5 |
| $MgSO_4$ [kg/odt] | 1 | 0 | 1 |
| Oxygen [kg/odt] | 0 | 0 | 4 |
| Estimated chemical cost [US$/odt] | 20.3 | 17.6 | 19.4 |

The results show that by utilizing the sequence $S_{inv4}$ it is possible to obtain a brightness of 91% ISO at a 10% lower chemical cost and a 30% lower COD generation than with the reference $S_{Ref3}$. The sequences $S_{inv4}$ and $S_{Ref3}$ result in substantially the same reverted brightness and will result in approximately the same investment cost of a bleach plant.

The sequence $S_{inv3}$ has a higher chemical cost but the investment cost of a bleach plant will be approximately the same as in the case of the reference $S_{Ref3}$. However, $S_{inv3}$ results in a 0.9% higher reverted brightness and a 30% lower COD generation than the reference $S_{Ref3}$.

At a reverted brightness of 89% ISO, the sequences $S_{inv3}$ and $S_{inv4}$ showed 5% and 12% lower chemical cost, respectively, when compared to the reference $S_{Ref3}$.

TABLE 3

| | $S_{inv3}$ | $S_{inv4}$ | $S_{Ref3}$ |
|---|---|---|---|
| Rev. Brightness [% ISO] | 89 | 89 | 89 |
| Bleaching stages | 3 | 3 | 3 |
| Total time [min] | 190 | 200 | 270 |
| Washers | 3 | 3 | 3 |
| Bleached pulp | | | |
| Brightness [% ISO] | 91.0 | 91.5 | 91.6 |
| Viscosity [ml/g] | 835 | 820 | 845 |
| Chemicals | | | |
| $ClO_2$ [kg active Cl] | 26 | 35 | 32 |
| $H_2O_2$ [kg/odt] | 5 | — | 3 |
| NaOH [kg/odt] | 11 | 10 | 11 |
| $H_2SO_4$ [kg/odt] | 5 | 5 | 5 |
| $MgSO_4$ [kg/odt] | 1 | 0 | 1 |
| Oxygen [kg/odt] | 0 | 0 | 4 |
| Estimated chemical cost [US$/odt] | 20.3 | 18.7 | 21.3 |

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for bleaching an oxygen delignified and washed pulp having a consistency of between 8 and 20% comprising:

(i) subjecting said pulp to a first chlorine dioxide bleaching step at a temperature of between about 80 to 95° C. and a pH of between about 2 and 4 to obtain a bleached pulp;

(ii) washing said bleached pulp to obtain a washed pulp;

(iii) subjecting said washed pulp at a consistency of between 8 and 20% to an alkaline extraction step to obtain an alkali-containing pulp;

(iv) adding chlorine dioxide to said alkali-containing pulp and adjusting the pH to obtain a second chlorine dioxide bleaching step, wherein step (iv) is performed directly after step (iii) without any intermediate washing step; and (v) subjecting said pulp to a peroxide treatment step directly after or after an intermediate wash following said second chlorine dioxide bleaching step.

2. A method according to claim 1 wherein said first chlorine dioxide bleaching step is carried out at a temperature of between about 85 and 95° C.

3. A method according to claim 1 wherein said washed pulp is subjected to an alkaline extraction step at a pH of between about 8 and 14.

4. A method according to claim 3 wherein said washed pulp is subjected to said alkaline extraction step at a pH of between about 9 and 12.

5. A method according to claim 1 wherein said pH is adjusted to an adjusted pH of between about 2 and 4 in step (iv).

6. A method according to claim 1 wherein said first chlorine dioxide bleaching step is carried out at a pH of between about 2.5 and 3.5.

7. A method according to claim 1 wherein said washed pulp is subjected to said alkaline extraction step at a temperature of between about 75 and 85° C.

8. A method according to claim 1 wherein said second chlorine dioxide bleaching step is carried out at a temperature of between about 75 and 90° C.

9. A method according to claim 1 wherein said pulp is a hardwood pulp.

10. A method according to claim 1 wherein said pulp is a Eucalyptus-based pulp.

* * * * *